United States Patent [19]

Hilbert

[11] Patent Number: 4,699,495

[45] Date of Patent: Oct. 13, 1987

[54] ELECTROGRAPHIC DEVELOPMENT APPARATUS HAVING COORDINATED GATE MECHANISM AND WIPER

[75] Inventor: Thomas K. Hilbert, Spencerport, N.Y.

[73] Assignee: Eastman Kodak Company, Rochester, N.Y.

[21] Appl. No.: 931,483

[22] Filed: Nov. 17, 1986

[51] Int. Cl.[4] ..... G03G 15/09; G03G 21/00

[52] U.S. Cl. ..... 355/3 DD; 118/657; 118/658; 355/15

[58] Field of Search ..... 355/3 R, 3 DD, 15; 118/656, 657, 658, 661

[56] References Cited

U.S. PATENT DOCUMENTS

| | | | |
|---|---|---|---|
| 3,572,288 | 3/1971 | Turner | 355/3 DD X |
| 3,575,139 | 4/1971 | Nuzum | 118/637 |
| 3,640,248 | 2/1972 | Nielander | 118/637 |
| 3,641,969 | 2/1972 | Hakanson | 118/3 |
| 3,995,589 | 12/1976 | Salger | 118/655 |
| 4,436,413 | 3/1984 | Oka | 355/15 |
| 4,480,905 | 11/1984 | Yoshino | 355/3 DD |
| 4,518,248 | 5/1985 | Nishikawa | 355/15 |
| 4,523,833 | 6/1985 | Jones | 355/3 DD |
| 4,571,071 | 2/1986 | Bothner | 355/15 |
| 4,634,286 | 1/1987 | Pike | 355/3 DD X |

FOREIGN PATENT DOCUMENTS 160830 11/1985 European Pat. Off. .

*Primary Examiner*—Fred L. Braun

*Attorney, Agent, or Firm*—G. Herman Childress

[57] ABSTRACT

A development station for electrographic apparatus has a magnetic brush which receives developer material from a sump and applies it to a latent image on a photoconductor. A metering slot for the developer material is provided adjacent the magnetic brush. A gate mechanism controls flow of developer material through the slot by moving between an open position adjacent the metering slot to allow developer material to pass through the slot and a closed position to block flow of developer material through the slot. A wiper blade removes excess developer material from the brush after the image has been developed. The wiper blade is movable into and out of engagement with the magnetic brush and is coupled to the gate mechanism so that when the gate is closed the wiper blade is out of engagement with the brush.

3 Claims, 4 Drawing Figures

ELECTROGRAPHIC DEVELOPMENT APPARATUS HAVING COORDINATED GATE MECHANISM AND WIPER

BACKGROUND OF THE INVENTION

This invention relates to a development station for an electrographic apparatus having a magnetic brush for developing an electrostatic image wherein flow of developer material to the brush and removal of material from the brush are controlled together for starting and stopping development of the images.

In electrographic development apparatus there is a recognized need to be able to create a layer of development particles on a magnetic brush quickly in order to develop an image and to shut off the flow of development material to the brush when development of images is not desired. For example, U.S. Pat. No. 3,579,139, issued Apr. 20, 1971, discloses a developer unit having devices which control the developing action of the unit so that the action can be switched on or off rapidly. The developer unit has two brushes, and a gate adjacent one of the brushes is mounted for movement into and out of engagement with the brush to control the flow of developer material to the one brush. The second brush of the developer unit has a magnet which is rotated to interrupt flow of developer material over the second brush. The magnet and the gate are controlled by the machine programming system and can be simultaneously operated by the programming system. A mechanism for controlling formation of bristles on the brush is needed not only for applying black toner but also in color copiers where toners of two or more colors are provided to a photoconductor, and it is important to be able to rapidly start and stop any one of several development stations with accuracy to avoid overlapping of the different toners on the photoconductor.

It is also known to provide a wiper blade for scraping developer material from a magnetic brush after the developer material has passed through the development zone. Such a wiper blade can return toner-depleted developer material to a sump for replenishment of toner before the developer material is again provided to the development zone. Such wiper blades tend to have a short useful life due to constant engagement of the blade with the magnetic brush.

SUMMARY OF THE INVENTION

It is an object of the present invention to provide electrographic development apparatus with improved gating of the flow of developer material to a magnetic brush, and to coordinate the gating action with operation of a wiper blade which removes developer material from the magnetic brush.

In accordance with the present invention an electrographic development station has a magnetic brush for applying developer material to a latent electrostatic image on a photoconductor to develop the image. The station has a metering slot adjacent the magnetic brush, and means are provided for feeding developer material to the slot so that the material can be provided to the brush for use in developing the image. A wiper blade removes excess developer material from the brush after the image has been developed. The improvement of the invention includes a gate mechanism which is mounted for movement between an open position adjacent the metering slot so that developer material can pass through the slot and a closed position wherein the gate mechanism blocks the developer material through the slot. Means are provided for moving the wiper blade into and out of engagement with the magnetic brush. Means are provided for coupling the wiper blade and the gate mechanism together for coordinated movement so that the wiper blade is in engagement with the magnetic brush when the gate mechanism is in its open position, and the wiper blade is out of engagement with the magnetic brush when the gate mechanism is in its closed position.

BRIEF DESCRIPTION OF THE DRAWINGS

In the detailed description of the preferred embodiments of the invention presented below, reference is made to the company drawings, in which.

DETAILED DESCRIPTION OF THE INVENTION

Figure 1:
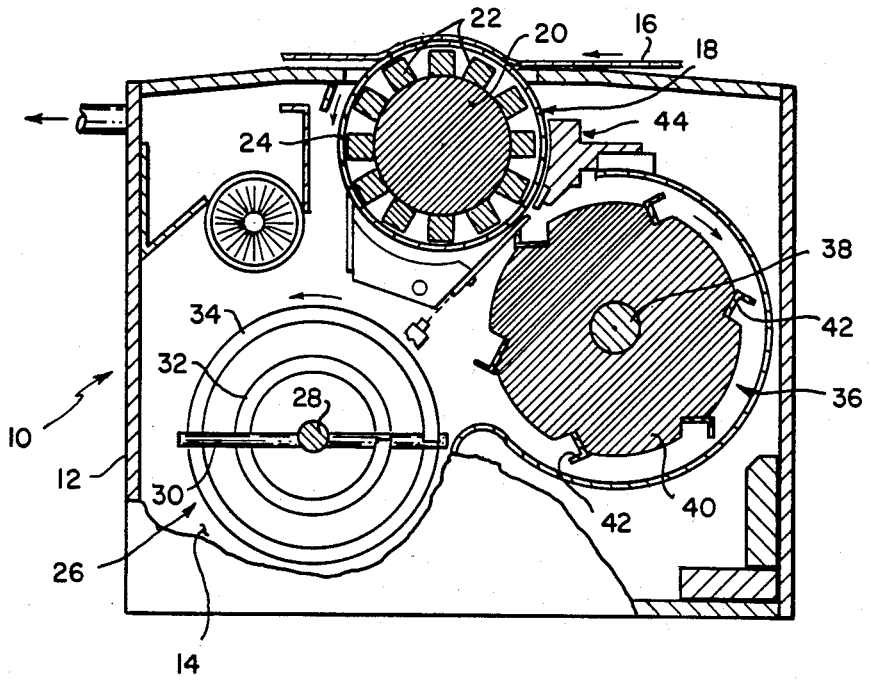
FIG. 1 is an end view of a development station of electrographic apparatus incorporating the present invention.

Referring now to FIG. 1 of the drawings, a development station of an electrographic apparatus is generally designated 10 and comprises a housing 12 that defines a sump 14 for receiving developer material. A photoconductor 16 travels across the upper portion of the housing 12 and contains on its lower surface one or more latent electrostatic images that are developed by developer material from sump 14. The developed images then can be transferred to a copy sheet and fused thereto in a known manner or fused onto the photoconductor itself.

The development station 10 has a magnetic brush 18 for applying developer material to the images on photoconductor 16. The brush illustrated comprises a core 20 having a plurality of magnets 22 spaced around the core, and a cylindrical, non magnetic shell 24 that surrounds the core 20. The core and/or shell can be rotatable, as known in the art. As illustrated in the drawings, the core 20 is rotatable in a clockwise direction, and the shell rotates in a counterclockwise direction to thereby feed developer material in a counterclockwise direction to the photoconductor.

Developer material in sump 14 can be mixed, agitated and triboelectrically sheared by means of a ribbon blender generally designated 26. Blender 26 comprises a shaft 28 that is rotatable about its axis and has a plurality of rods 30 projecting therefrom. The rods carry inner and outer helical ribbons 32, 34. The pitch of the ribbon 32 is opposite from ribbon 34 so that when the shaft 28 is driven in a counterclockwise direction as shown in FIG. 1, ribbon 32 tends to drive developer material in one direction through the sump 14 while ribbon 34 tends to drive the material in the opposite direction.

Material from sump 14 is moved by the ribbon blender not only axially in the sump but also radially outwardly so that some of the material is provided to a feeding means generally shown at 36. Feeding means 36 includes a shaft 38 is rotated in a clockwise direction and carries two or more plates 40. The plates support a plurality of vanes 42 that pick up developer material from the ribbon blender 26 and bring such material into close proximity with the shell 24 of the magnetic brush 18. At that point the magnets 22 of the core 20 attract the developer material to the shell so that it can be delivered to the photoconductor 16. The thickness of the layer of the developer material on the shell is controlled by a metering skive 44 located adjacent but spaced from the outer surface of the shell 24 and between the feeding means 36 and the photoconductor 16.

The apparatus described hereinbefore is disclosed in more detail in European Patent Office Publication No. 160,830, published Nov. 13, 1985, which is based on U.S. patent application Ser. No. 597,323, filed Apr. 6, 1984. Reference is made to that publication for a more complete description of the apparatus.

Figure 2:
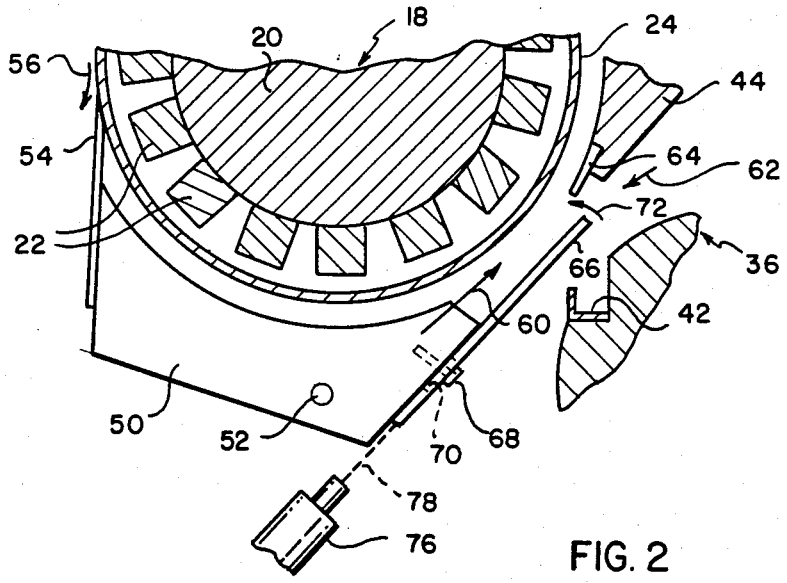
FIG. 2 is an enlarged fragmentary view of the gating mechanism and wiper plate of FIG. 1 shown with the gate open and the wiper blade engaged with the magnetic brush.
Figure 3:
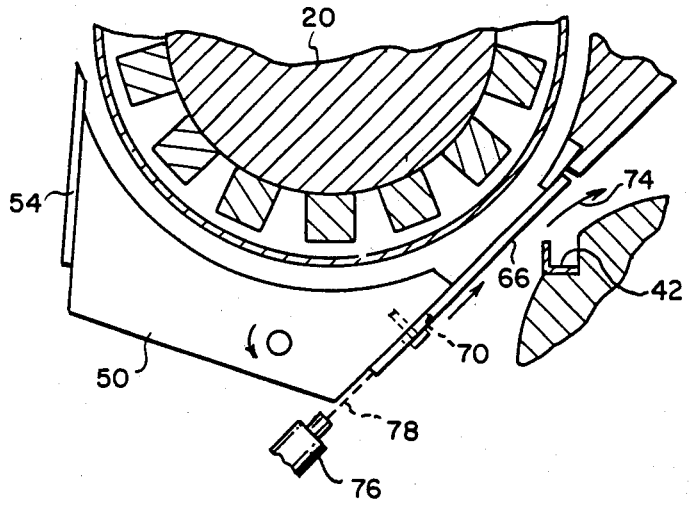
FIG. 3 is a view similar to FIG. 2 but showing the gate mechanism in its closed position and the wiper blade spaced from the magnetic brush.

Referring now to FIGS. 1–3 of the drawings, a wiper block 50 is provided between the magnetic brush 16 and the ribbon blender 26. The block is mounted for pivotal movement about a pivot 52. Along the left side of the block there is provided a wiper blade 54 which extends substantially the full length of the magnetic brush 18. Normally the wiper blade is in contact with the shell 24 of the magnetic brush to scrape developer material from the shell, as shown by arrow 56, and return such material to the sump for mixing with other developer material in the sump.

A metering slot 60 for developer material flowing to the magnetic brush is defined by the skive 44 and the wiper block 50. The width of the metering slot is exaggerated in the drawings to better illustrate the slot and related structures. Flow of material through slot 60 is controlled by a gate mechanism 62. The gate mechanism comprises an abutment 64 located along the edge of skive 44 and extending substantially the full length of the magnetic brush 18.

The gate mechanism also includes a gate 66 that is slideably mounted on the block 50 by one or more bolts 68 that are mounted on the block and extend through elongate slots 70 in the gate. This mounting of the gate on the block 50 allows it to be moved between an open position shown in FIG. 2 and a closed position shown in FIG. 3. When the gate mechanism is in the open position developer material can flow along the path shown by arrow 72 between the end of the gate 66 and the abutment 64 and thus flow through the metering slot 60 and be provided to the magnetic brush 18. On the other hand, when the gate is moved to its closed position shown in FIG. 3 the end of the gate 66 contacts the abutment 64 and thus effectively blocks the flow of developer material through the metering slot to the magnetic brush, thereby cutting off the flow of developer material to the photoconductor 16. At that point any further developer material advanced by the feed means 36 will travel along the path shown by arrow 74 in FIG. 3 leading toward the sump 14.

During initial movement of the gate 66 from its FIG. 2 toward its FIG. 3 position the gate moves relative to wiper block 50 due to the elongate slot 70. After that initial movement the end of the slot strikes the mounting bolt 68 to cause pivotal movement of the wiper block 50 about the axis of pivot 52. This effects movement of the wiper blade 54 from its FIG. 2 to its FIG. 3 position and thereby disengages the wiper blade from the outer surface of shell 24. Thus the wiper blade is coupled to the gate so that the movement of the gate and blade are coordinated to ensure that the wiper blade is in engagement with the shell when the gate mechanism is open and to ensure separation of the wiper blade from the shell when the gate mechanism is closed.

Movement of the gate mechanism 62 and block 50 can be accomplished in any suitable manner. For example, a solenoid 76 can be provided and connected to the gate 66 as shown diagrammatically at 78.

Figure 4:
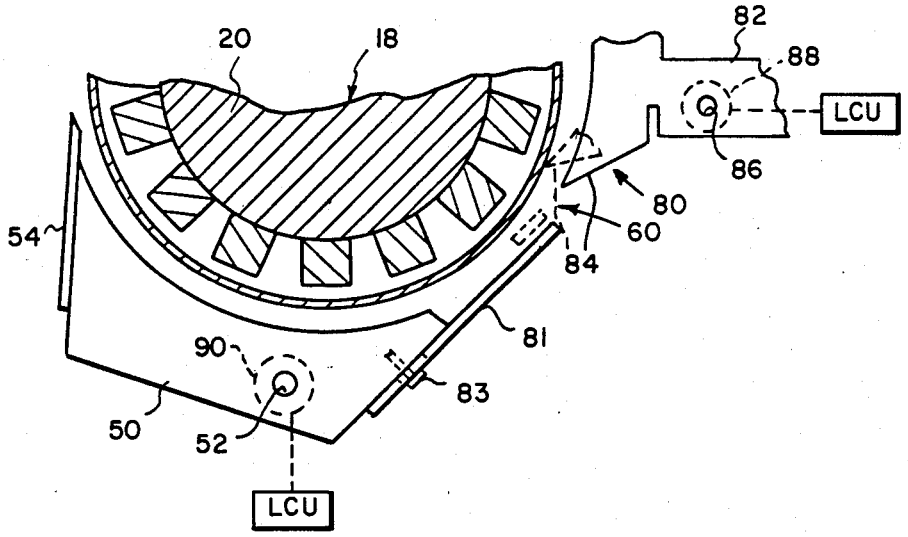
FIG. 4 is a fragmentary view similar to FIG. 2 showing a modification of the invention.

A modification of the invention is illustrated in FIG. 4 of the drawings. In FIG. 4 the same reference numerals have been used to indicate the same or similar parts. In this embodiment the gating mechanism for controlling the flow of developer material through the metering slot 60 is provided by a tapered end portion 80 of a metering skive 82. The tip end 84 of end portion 80 normally is positioned in closely spaced relation to the gate 66 attached to the metering block 50. In this embodiment a gate 81 is rigidly secured to the block 50 by mounting bolts 83.

Skive 82 is mounted for pivotal movement about the axis of a pivot 86 so that the tip 84 can be moved from its solid to its dotted line positions. When in the solid line position the skive 82 allows developer material to flow through the metering slot 60 to the magnetic brush 18 and skive 82 defines the thickness of the layer of developer material on the brush. When the skive is pivoted to bring the tip 84 to its dotted line position, the tip engages the outer surface of the shell 24 of the magnetic brush to close the metering slot to the flow of developer material and scrape any developer material from the brush. This pivotal movement can be affected by any suitable means, such as by a rotary solenoid shown at 88 which is connected directly to the pivot 86 and is effective, when energized, to swing the skive between the positions illustrated.

The wiper blade 54 can be moved from a position in engagement with the outer surface of shell 24 to a position spaced therefrom by a similar rotary solenoid 90 connected to the pivot 52 for the metering block 50 so that when the solenoid is energized it swings the metering block in a counterclockwise direction to move the blade 54 away from the shell. Both solenoids 88 and 90 can be controlled from the logic and control unit LCU of the electrographic apparatus so that their movements and operation are coordinated. The solenoids can be energized simultaneously, or if desired, solenoid 88 can be energized to shut off the flow of material through the metering slot 60 a brief period of time before the wiper blade 54 is disengaged from the sleeve 24. This allows the wiper blade to scrape developer material from the shell that was on the shell before the metering slot was closed by the tip 84 of the skive.

During operation of either of the embodiments of the invention, the ribbon blender 26 is effective to circulate and mix developer material in sump 14, triboelectrically charge it and provide such material to the feed means 36. The feed means 36 picks up the developer material and delivers it to the metering slot 60. When the metering slot is open, as shown in FIG. 2 and in solid lines in FIG. 4, the magnets 22 of the magnetic brush attract the developer material through the slot to allow its transportation to the photoconductor 16 for developing of electrostatic images thereon. The thickness of developer material on the magnetic brush is governed by the metering skives 44 and 82. After the developer material passes to the left side of the magnetic brush and past the development zone between the magnetic brush and the photoconductor, the developer material remaining on the magnetic brush is removed by the wiper blade 54 which allows it to return to the sump for mixing with other material therein. Additional fresh toner can be provided to the sump in a conventional manner.

When it is desired to shut off the flow of developer material to the magnetic brush, the gate mechanism of FIGS. 1–3 is energized by solenoid 76 which affects movement of the gate 66 toward the skive 44. After some movement of the gate, the left end of slot 70 will engage the mounting bolt 68 to effect pivotal movement of the wiper block 50 and thus separate the wiper blade 54 from the magnetic brush just as the gate 66 comes into contact with the abutment 64 to shut off the metering slot. At this time the parts are in the position illustrated in FIG. 3 and developer material brought toward the metering slot by the feed means 36 will travel along the path shown by the arrow 74 and be returned to the sump.

In a similar manner, when solenoids 88 and 90 of FIG. 4 are energized the skive 82 swings to its dotted line position so that its tip end engages the sleeve 24 of the magnetic brush to close the gate and shut off the flow of developer material to the brush. Simultaneously, or after a slight delay, solenoid 90 swings the metering block 50 about pivot 52 to bring the wiper blade 54 to its dotted line position.

There are a number of advantages resulting from the invention. Developer material ages during use, and developer aging is decreased by stopping the flow of the developer material to the magnetic brush during periods when images are not to be developed. Secondly, this termination of flow of developer material around the magnetic brush also decreases contamination by the development station of adjacent areas due to dusting that occurs by circulation of the developer material. Another advantage is that the wiper blades have a tendency to age quickly due to their constant contact with the shell of the magnetic brush. By separating the wiper blade from the shell during periods of non use, the life of the wiper blade can be increased.

In some instances color copies are produced in electrographic apparatus having two or more developer stations. In such stations it is important to make certain that toner materials of one color are provided to the photoconductor at any given time or, alternatively, that other developer apparatus for another color toner is separated from the photoconductor while toner of one color is being provided to the photoconductor. By gating the development station to its closed position utilizing the mechanisms of the present invention, there is no longer a need to move the entire toning station relative to the photoconductor, as typically occurred with prior art apparatus.

Another advantage of the invention is that it reduces the torque required for operation of the development station. More specifically, transport of development material around the magnetic brush requires a certain amount of torque. By shutting off the flow of material around the development station during periods of non use, the torque requirements are reduced. This is important in electrographic apparatus because such apparatus have fairly highpower requirements and the power requirements can constitute a limitation on addition of other apparatus. Moreover, the application of torque is accompanied by the generation of heat and possibly eddy currents which adversely affect the operation of the apparatus.

The invention has been described in detail with particular reference to preferred embodiments thereof, but it will be understood that variations and modifications can be effected within the spirit and scope of the invention as described hereinabove and as defined in the appended claims.

I claim:

1. In a development station of an electrographic apparatus having a magnetic brush for applying developer material to a latent electrostatic image on a photoconductor to develop the image, the station having means defining a metering slot adjacent the magnetic brush, means for feeding developer material to the slot so that the material can be provided to the brush for use in developing the image, and a wiper blade for removing excess developer material from the brush after the image has been developed, the improvement comprising:

a gate mechanism mounted for movement between (1) an open position adjacent the metering slot wherein developer material can pass through the slot and (2) a closed position wherein the gate mechanism blocks flow of developer material through the slot, means for moving the wiper blade into and out of engagement with the magnetic brush, and means coupling the wiper blade and the gate mechanism together for coordinated movement so that (1) the wiper blade is in engagement with the magnetic brush when the gate mechanism is in its open position and (2) the wiper blade is out of engagement with the magnetic brush when the gate mechanism is in its closed position.

2. The invention as set forth in claim 1 further including a mounting member adjacent the magnetic brush, means pivotally mounting the member, the wiper blade being attached to the member and being movable with the member, and the gate mechanism having a gate member attached to the mounting member.

3. In a development station of an electrographic apparatus having a magnetic brush for applying developer material to a latent electrostatic image on a photoconductor to develop the image, the station having means including a skive defining a metering slot adjacent the magnetic brush, means for feeding developer material to the slot so that the material can be provided to the brush for use in developing the image, a wiper block adjacent the magnetic brush, and a wiper blade mounted on the block and engageable with the brush for removing excess developer material from the brush after the image has been developed, the improvement comprising:

a gate mechanism moveable between (1) an open position adjacent the metering slot wherein developer material can pass through the slot and (2) a closed position wherein the gate mechanism blocks flow of developer material through the slot, the gate mechanism having a member attached to the block and cooperating with the skive to define the open and closed positions of the gate mechanism, and means for moving the wiper block between two positions to move the wiper blade into and out of engagement with the magnetic brush, and to move the gate member relative to the skive, whereby (1) the wiper blade is in engagement with the magnetic brush when the gate mechanism is in its open position and (2) the wiper blade is out of engagement with the magnetic brush when the gate mechanism is in its closed position.

* * * * *